US006675442B2

(12) United States Patent
Reinehr et al.

(10) Patent No.: US 6,675,442 B2
(45) Date of Patent: Jan. 13, 2004

(54) METHOD FOR THE STORING OF ELASTAN FILAMENTS WITH COARSE TIRES

(75) Inventors: Ulrich Reinehr, Dormagen (DE); Tilo Sehm, Düsseldorf (DE); Wolfgang Anderheggen, Dormagen (DE); Toni Herbertz, Dormagen (DE)

(73) Assignee: Bayer Faser GmbH, Dormagen (DE)

( * ) Notice: Subject to any disclaimer, the term of this patent is extended or adjusted under 35 U.S.C. 154(b) by 0 days.

(21) Appl. No.: 10/011,625

(22) Filed: Oct. 22, 2001

(65) Prior Publication Data

US 2002/0083566 A1 Jul. 4, 2002

(30) Foreign Application Priority Data

Oct. 23, 2000 (DE) ..... 100 52 478

(51) Int. Cl.[7] ..... D04H 11/00
(52) U.S. Cl. ..... 19/159 R
(58) Field of Search ..... 19/159 R, 163, 19/150, 157; 28/289; 53/235, 116, 429; 206/388; 428/364, 365

(56) References Cited

U.S. PATENT DOCUMENTS 3,351,992 A * 11/1967 Carter ..... 53/429
3,509,687 A * 5/1970 Fleissner ..... 53/116
3,968,877 A * 7/1976 Mattis ..... 206/388
4,003,195 A * 1/1977 Fernstrom et al. ..... 57/293
4,069,566 A * 1/1978 Sumitomo et al. ..... 28/289
4,185,064 A 1/1980 Schippers ..... 264/210.2
4,554,716 A * 11/1985 Nunn ..... 28/263
5,456,946 A * 10/1995 Snellman ..... 427/222
5,644,818 A * 7/1997 Price et al. ..... 19/159 R
5,670,105 A * 9/1997 Reinehr et al. ..... 264/184
5,756,205 A * 5/1998 Reinehr et al. ..... 428/364
5,913,797 A * 6/1999 Saleh ..... 53/429

FOREIGN PATENT DOCUMENTS

DE 1 510 248 10/1970 ..... B65H/79/00
EP 0 157 543 10/1985 ..... B65H/51/16

OTHER PUBLICATIONS

Ullmann, Encyclopedia of Industrial Chemistry, vol. A10; p. 613, Fig. 15 and 17, VCH Verlagsgesellschaft, Weinheim; 1987.

* cited by examiner

*Primary Examiner*—Gary L. Welch
(74) *Attorney, Agent, or Firm*—Norris McLaughlin & Marcus

(57) ABSTRACT

There is described a method for the storing of elastan filaments with a titre of at least 2,500 dtex in drums with a filament line length of at least 10 km with the use of a displacing device, in which the filaments are stored meandering in layers, and in which the filaments are inlaid into the drum at a speed of at least eight per cent above the production speed of the filaments.

8 Claims, 1 Drawing Sheet

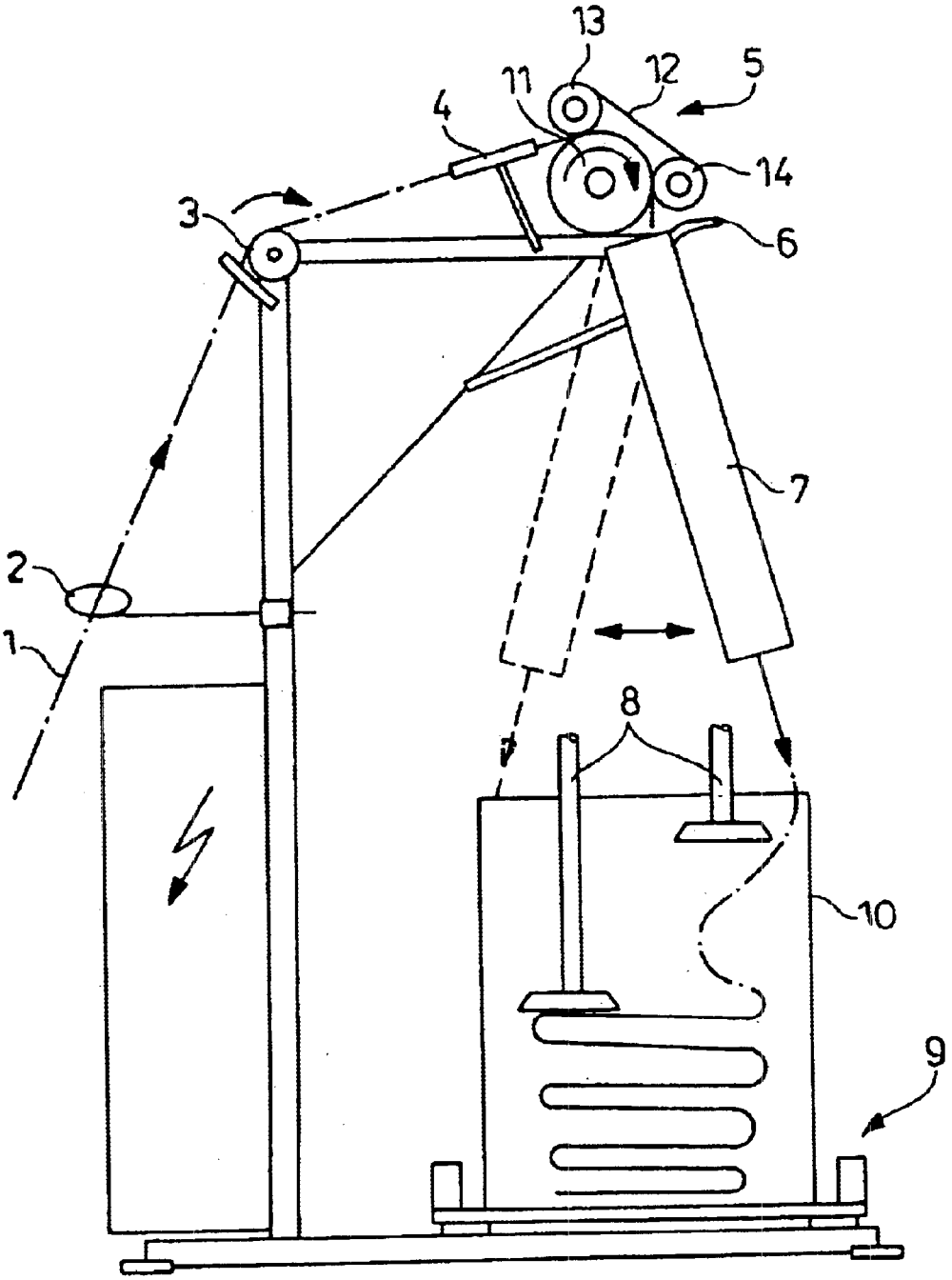
13
11
12
5
4
14
3
6
7
2
1
8
10
9

METHOD FOR THE STORING OF ELASTAN FILAMENTS WITH COARSE TIRES

Elastan filaments with a titre of at least 2,500 dtex according to the wet spinning method were disclosed for the first time in laid-open print DE 198 290 63 A1. Coarse titres of this kind, which are present in tape form with tape widths of typically approx. 2 to 10 mm and are found in the typical application areas of natural rubber threads, are very attractive economically. Areas of use are, for example, elastic undertapes for upholstery fabrics, base material for underwear, leg borders for lingerie and bathing articles, and special hygiene articles in the medical sector.

In the production of elastan filaments by the dry, wet or melt spinning method, the filaments are as a rule wound on spools. Compare e.g. Ullmann: Encyclopedia of Industrial Chemistry, Vol. A 10; p. 613, FIGS. 15 and 17, VCH Verlagsgesellschaft, Weinheim; 1987.

Depending on the titre, spools with various tube widths, e.g. of approx. 58 to 160 mm, are used. In addition, spools with various weights of elastan filaments are produced.

Tube width and spool weights are naturally governed by the titres of the elastan filaments spun. In order to obtain the highest possible filament line lengths and hence the fewest possible interruptions in the processing of the elastan filaments, elastan filaments for example of 1,280 dtex are produced on wide tubes of 160 mm length with weights of up to approx. 1.5 kg. This corresponds to a filament line length of approx. 11.7 km.

With still coarser titres above 2,500 dtex, correspondingly less line length is achieved on tubes of 160 mm length and 1.5 kg spool weight. Thus for a coarse titre of 10,000 dtex, for example, the filament line length amounts to only 1.5 km under the conditions given above.

Spools of this kind can no longer be used economically due to their short line lengths.

With a production speed of 100 m/min, for example, the spool running time in fact amounts to only 15 minutes in the above case. This means high staff levels for the spool change, which in turn leads to economic disadvantages in the application of spools.

Even if the spool weights are increased, for example to 3 kg, the filament line length continues to be completely unsatisfactory. Furthermore, said heavy spools are more difficult to handle, to transport and to pack by the staff.

The object of the present invention was to correct these serious drawbacks and to provide a store for coarse-titre elastan filaments of more than 2,500 dtex with sufficiently large line length of at least 10 kin, preferably 15 km and in particular of more than 20 km.

It was found that this object can be achieved by using instead of the otherwise conventional winding devices for spools a displacing device with draw-in mechanism and inlaying device for the storing in drums, and by storing the coarse elastan filaments with a titre of more than 2,500 dtex in cartons, instead of winding them on spools.

The invention provides a method for storing elastan filaments with a titre of at least 2,500 dtex in drums with a filament line length of at least 10 kin, preferably at least 15 kin, particularly preferably at least 20 kin, with the use of a displacing device, wherein the filaments are stored meandering in layers, characterised in that the filaments are inlaid into the drum at a speed of at least 8%, preferably at least 10% above the production speed of the filaments. Because the storing meanders, i.e. runs to and fro in the drum, the space in the drum is particularly well utilised.

Preferably a draw-in roller which comprises a teflon coating (PTFE) or a paper jacketing is used to produce the inlaying into the drum.

Particularly preferably a pivoted, funnel-shaped inlayer is used for the storing, whose width at its bottom end, viewed at right angles to the pivoting direction, amounts to not more than 100 mm.

The filaments running into the inlayer are preferably blown on with compressed air in the running direction of the filaments.

This serves to prevent wraps in the area of the storing.

The stored filaments are preferably additionally compressed in the drum, in particular with the use of several press rams, in order to ensure a higher packing density.

The drum is particularly preferably caused to oscillate transversely to the filament running direction and at right angles to the pivoting direction of the inlayer during the storing of the filaments, in order to make optimum use of the space in the drum.

In order to store the elastan filaments as smoothly as possible, the additional transverse oscillating of the carton has proved to be particularly effective. In addition, a uniform filling of the carton is also obtained particularly in the corners if so-called tape holding-down devices, which may be operated alternately, are used as press rams.

Tape displacing devices for the storing of filaments are known in principle.

It was found that coarse elastan filaments of 2,500 dtex and more cannot be processed automatically on the known displacing devices. Filament pile-ups and lapping arise in all cases, because of adhesion proneness and speed differences due to the elastic material, which may exhibit up to 700% extension.

Rubber-covered rolls or rollers in the draw-in mechanism of the displacing machine lead in particular increasingly to lapping due to adhesion proneness of the elastan filaments.

The use of teflon-coated draw-in rollers, or rolls or rollers coated with hard paper, ensures, conversely, satisfactory operation.

Because of the high extension and elasticity of the filaments, the speed between the delivery of the filament, the so-called production speed, and the speed of the preferably hard paper-coated draw-in rollers must be coordinated well with one another. As a rule an advance speeding-up of the draw-in rollers of 10% is sufficient with production speeds of less than 100 m/min. At higher speeds the advance speeding-up of the draw-in rolls or rollers comes with advantage to 20 to 50% more than the production speed of the elastan filaments.

Filament pile-up of the elastan filaments occurs mainly at the hand-over point of the filaments from the draw-in mechanism onto the oscillating special funnel draw-in. In order to prevent adhesion in the storage funnel, the supply of compressed air in the filament running direction directly at the funnel inlet has proved to be particularly suitable. Depending on production speed and throughput, it is often of advantage for the compressed air supply at the funnel inlet to be distributed over 2 points in some cases. In general small amounts of compressed air of between 1.2 to 1.5 bar are quite sufficient to achieve good passage of the filaments.

A further important role for an improved tape storage in the carton is also played by the funnel width of the oscillating inlayer to be used.

It was found that a relatively particularly loop-free tape storage of the elastan filaments is always obtained if the funnel width comes with titres of up to 10,000 dtex in particular to not more than 50 mm, preferably 30 mm and less.

In order to ensure a satisfactory storing of the coarse-titre elastan filaments in the carton, an additional transverse oscillation of the carton, offset 90° relative to the filament running direction, has proved to be beneficial, as was described above.

By alternate restraining of the elastan tape with a tape holding-down device in the form of two rams, a significantly higher proportion of parallel storings of the elastan tape is obtained.

Cartons with the dimensions 600 mm length×400 m width×500 mm height have provided to be particularly suitable carton sizes for the storing of the elastans. There may be stored in such cartons, for example, elastan filaments of the titre 10 000 dtex with 20 to 30 kg fabric weight, which corresponds to a filament line length of approx. 20 to 30 km.

The following examples serve for the further development of the invention, without limiting it. FIG. 1 shows a modified displacing device.

EXAMPLES

Example 1

A coarse-titre elastan filament with the titre 10,800 dtex, produced according to Example no. 6, Table 1, of DE 19 829 063 A1 was fed at a production speed of 120 in/mm to a displacing machine as per flow sheet according to FIG. 1. The tape width was 5.1 mm. The filament 1 was fed via a filament guide 2 to a deflection roller 3, passed through an ioniser 4 and transferred to the draw-in mechanism 5. The draw-in mechanism 5 was equipped with a hard paper-coated roller 11 and with an endless rubber tape 12, which is directed via two further rollers 13, 14. The draw-in mechanism 5 feeds the elastan filament at 132m/min, which corresponds to a 10% higher speed than the supplying production speed. Via two lateral slit nozzles 6 the filament is acted upon at the funnel input of the inlayer with weak compressed air of approx. 1.5 bar, in order to prevent an adhesion of the filament at said point. The funnel width of the inlayer 7 comes at its end to 50 mm. The elastic filament 1 is then stored in the carton 10, wherein a slow oscillating 9 of the carton, namely lateral relative to the filament running direction and offset 90°, takes place. A uniform arrangement of filament positions is made possible in this way. During the oscillating the elastic filament is in addition pressed against by the two tape holding-down devices 8 in turn, so that during the inlaying parallel filament storings are achieved in the carton by temporary restraining of the elastan filament.

A carton with the dimensions 600 mm length×400 mm width×500 mm height was used. A total of 25 kg of elastan filaments of titre 10,800 dtex was stored. The filament line length amounts to approx. 23.1 km. The filament material from the carton was able, for the processing to elastic base material, to be drawn off out of the carton without looping and fed to the processing machines.

Example 2

A coarse-titre elastan filament with the titre 2,520 dtex and a tape width of approx. 2 mm was fed to the displacing machine according to FIG. 3 at a production speed of 130 in/mm. The filament was, as described in Example 1, drawn off above the draw-in mechanism at a speed of 195 in/mm, which corresponds to a 50% higher speed than the production speed. The draw-in mechanism was equipped with teflon-coated rollers. Once again there was added at the funnel input of the inlayer, via two slit nozzles, a weak compressed air current of 1.2 bar. The funnel width of the inlayer amounted to 30 mm at its bottom end. The elastic filament was, as demonstrated further in example 1, inlaid into a carton 600 mm long×400 mm wide and 200 mm high. A total of 10 kg of elastan filaments of the titre 2,520 dtex was stored, which corresponds to a filament line length of approx. 39.7 km. The filament material was in turn drawn off out of the carton without looping for the processing.

What is claimed is:

1. Method for the storing of elastan filaments with a titre of at least 2,500 dtex in drums with a filament line length of at least 10 km, with the use of a displacing device, in which the filaments are stored meandering in layers, wherein the filaments are inlaid into the drum at a speed of at least 8%, above the production speed of the filaments and wherein there is used for the storing a pivoting, funnel-shaped inlayer whose width at its bottom end, viewed at right angles to the pivoting direction, amounts to not more than 100 mm.

2. Method according to claim 1, wherein a draw-in roller is used to produce the inlaying into the drum, which draw-in roller comprises a teflon coating or a paper jacketing.

3. Method according to claim 1, wherein the filaments running into the inlayer are blown on with compressed air in the running direction of the filaments.

4. Method according to claim 1, wherein the drum is caused to oscillate transversely to the filament running direction during the storing of the filaments.

5. Method according to claim 1, wherein the filaments stored in the drum are additionally compressed by several press rams.

6. The method of claim 1, wherein said speed is at least 10% above the production speed of the filaments.

7. The method of claim 1, said width is not more than 50 mm.

8. The method of claim 2, wherein said width is 30 mm or less.

* * * * *

UNITED STATES PATENT AND TRADEMARK OFFICE

CERTIFICATE OF CORRECTION

PATENT NO. : 6,675,442 B2
DATED : January 13, 2004
INVENTOR(S) : Reinehr et al.

It is certified that error appears in the above-identified patent and that said Letters Patent is hereby corrected as shown below:

Column 1,
Lines 47 and 57, “10 kin” should read -- 10km --.
Line 58, “kin, particularly preferably at least 20 kin” should read -- km, particularly preferably at least 20 km --.

Column 3,
Line 24, “120 in/mm” should read -- 120 m/min --.

Column 4,
Lines 8-9, “130 in/mm” should read -- 130 m/min --.
Line 10, “195 in/mm” should read -- 195 m/min --.

Signed and Sealed this

Thirteenth Day of July, 2004

JON W. DUDAS
*Acting Director of the United States Patent and Trademark Office*